US006644490B2

(12) United States Patent
Clarke

(10) Patent No.: US 6,644,490 B2
(45) **Date of Patent: *Nov. 11, 2003**

(54) LID

(75) Inventor: Brian Norman Clarke, Huntingdon (GB)

(73) Assignee: Solo Cup Company, Highland Park, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/924,418

(22) Filed: Aug. 6, 2001

(65) Prior Publication Data

US 2002/0170912 A1 Nov. 21, 2002

(30) Foreign Application Priority Data

May 17, 2001 (GB) ..... 0112077

(51) Int. Cl.[7] ..... B65D 51/18; B65D 55/16; A47G 19/22

(52) U.S. Cl. ..... 220/254.1; 220/254.3; 220/832; 220/375; 220/713

(58) Field of Search ..... 220/254.1, 254.2, 220/254.3, 254.7, 379, 375, 703, 711, 713, 714, 716, 717, 831, 832, 744, 266; 215/306; 222/543

(56) References Cited

U.S. PATENT DOCUMENTS

| | | | |
|---|---|---|---|
| 1,237,228 | A | 8/1917 | Westover |
| 1,896,976 | A | 2/1933 | Schifferdecker |
| 2,121,554 | A | 6/1938 | Thorn |
| 3,031,111 | A | 4/1962 | Stull |
| 3,083,861 | A | 4/1963 | Amberg et al. |
| 3,188,036 | A | 6/1965 | Sprung |
| 3,193,130 | A | 7/1965 | Miller |
| 3,262,612 | A | 7/1966 | Tabor |

(List continued on next page.)

FOREIGN PATENT DOCUMENTS

| | | | |
|---|---|---|---|
| CH | 393 955 | | 11/1965 |
| DE | 29502654 | * | 8/1995 |
| EP | 383442 | * | 8/1990 |
| GB | 1 600 917 | | 10/1981 |
| JP | 07-390379 | | 11/1995 |
| JP | 2000-159254 | * | 6/2000 |
| WO | WO 99 47429 | | 9/1999 |
| WO | WO 00 151908 | | 9/2000 |

OTHER PUBLICATIONS

US 6,003,721, 12/1999, Fleming (withdrawn)

Berrington, N., *International Search Report*, Sep. 4, 2002, 6 pp., Patent Cooperation Treaty, Rijswijk, Netherlands.

Copy of photograph of HotJo Ceramic Mug/Lid obtained through market research, Apr. 2000.

(List continued on next page.)

*Primary Examiner*—Nathan J. Newhouse
(74) *Attorney, Agent, or Firm*—Wallenstein & Wagner, Ltd.

(57) ABSTRACT

A lid, suitable for "take-away" hot and cold beverage containers, which reduces spillage of the container contents and allows the user to store the container contents for consumption at a later date. The lid comprises a main body portion, incorporating an aperture for discharging the container contents, and a flexible arm portion, connected to the body portion and having a closure member positioned thereon. When a user requires to store the contents of the container for consumption at a later date, the flexible arm portion can be bent over the top of the main body portion and the closure member engaged in the aperture so as to seal it. The main body portion may also include a recess, suitably shaped to receive the closure member, wherein, when the user requires to discharge the container contents through the aperture, the closure member can be engaged in the recess such that the arm portion does not interfere with the discharge of the container contents through the aperture.

15 Claims, 3 Drawing Sheets

U.S. PATENT DOCUMENTS 3,326,401 A 6/1967 De Long
3,459,324 A 8/1969 Miller
3,690,514 A * 9/1972 Wilson ..... 222/546
3,805,991 A 4/1974 Cheladze et al.
3,874,580 A 4/1975 Weatherhead, III
4,091,956 A 5/1978 Vecchio
4,138,033 A 2/1979 Payne et al.
4,141,461 A 2/1979 LaChance
4,183,443 A 1/1980 DeParales et al.
4,188,457 A 2/1980 Throp
4,331,255 A 5/1982 Fournier
4,333,583 A 6/1982 Montemarano
4,345,695 A 8/1982 Galloway
4,347,946 A 9/1982 Nichols
4,350,260 A 9/1982 Prueher
4,361,249 A 11/1982 Tuneski et al.
4,420,092 A 12/1983 Finkelstein
4,441,624 A 4/1984 Sokolowski
4,449,640 A 5/1984 Finkelstein
4,503,992 A 3/1985 Sitko et al.
4,557,398 A 12/1985 Hambleton et al.
4,570,817 A 2/1986 Hambleton et al.
4,579,245 A 4/1986 Narushko
4,589,569 A 5/1986 Clements
4,598,837 A 7/1986 Kreiseder et al.
4,619,372 A 10/1986 McFarland
4,629,088 A 12/1986 Durgin
4,657,139 A 4/1987 Hanifl
4,705,197 A 11/1987 Gordon et al.
4,718,570 A 1/1988 Diener
4,738,373 A 4/1988 DeParales
4,741,450 A 5/1988 Braude
4,770,325 A 9/1988 Gordon et al.
4,782,975 A 11/1988 Coy
4,790,444 A 12/1988 Terzi
4,792,054 A 12/1988 Weidman
4,796,774 A 1/1989 Nabinger
4,863,051 A 9/1989 Eibner et al.
4,869,389 A 9/1989 Cerrone, Jr.
4,899,902 A 2/1990 DeMars
4,915,250 A 4/1990 Hayes, Jr.
4,932,555 A 6/1990 La Barge
4,938,379 A 7/1990 Kellner
4,949,865 A 8/1990 Turner
4,953,743 A 9/1990 Dart et al.
5,012,061 A 4/1991 Lesser
5,111,961 A 5/1992 Van Melle
5,148,936 A 9/1992 DeGrow
5,167,338 A 12/1992 Kick
5,180,073 A 1/1993 Fay et al.
5,183,172 A 2/1993 Boller
5,193,704 A 3/1993 Kick
5,197,624 A 3/1993 Doddaro
5,205,430 A 4/1993 Valyi
D346,718 S * 5/1994 Timmermans ..... D7/392.1
5,395,006 A 3/1995 Verma
5,398,843 A 3/1995 Warden et al.
5,415,312 A * 5/1995 Mueller ..... 220/254.3
5,421,472 A 6/1995 Beckertgis
5,449,085 A 9/1995 Brun, Jr.
5,485,938 A 1/1996 Boersma
5,490,609 A 2/1996 Lane et al.
5,495,941 A 3/1996 Leonard
5,497,920 A 3/1996 Moeller et al.
5,503,289 A 4/1996 Fox
5,503,662 A 4/1996 Berger
5,588,561 A 12/1996 Ness
5,613,619 A 3/1997 Van Melle
5,699,927 A 12/1997 Lane et al.
5,706,972 A 1/1998 Sousa
5,718,353 A 2/1998 Kanfer et al.
5,727,707 A 3/1998 Wickland et al.
5,766,660 A 6/1998 Lee et al.
5,775,205 A 7/1998 Melton
5,839,601 A 11/1998 Van Melle
5,866,184 A 2/1999 Gorlich et al.
5,873,298 A 2/1999 Chang
5,913,964 A 6/1999 Melton
5,947,319 A 9/1999 Sinski
5,947,323 A 9/1999 Freek et al.
5,954,241 A 9/1999 Huang
5,979,689 A 11/1999 Lansky
5,984,127 A * 11/1999 Fenton ..... 220/254.1
5,996,837 A 12/1999 Freek et al.
6,003,711 A 12/1999 Bilewitz
6,010,029 A 1/2000 Wang
6,089,397 A 7/2000 Van Melle
6,095,033 A 8/2000 Melton
6,176,384 B1 1/2001 Voloshin
6,199,711 B1 3/2001 Lansky
6,216,904 B1 4/2001 Cagan
6,220,470 B1 4/2001 McHenry et al.
6,305,571 B1 10/2001 Chu

OTHER PUBLICATIONS

Copy of photograph of Starbucks Cup/Lid obtained through market research, Apr. 2000.
Copy of photograph of Super America Cup/Lid obtained through market research, Apr. 2000.
Copy of photograph of Dunkin Donuts Cup/Lid obtained through market research, Apr. 2000.
Seven (7) color photographs showing different views of Whirley Thermo Mug/Lid obtained in early 2003.

* cited by examiner

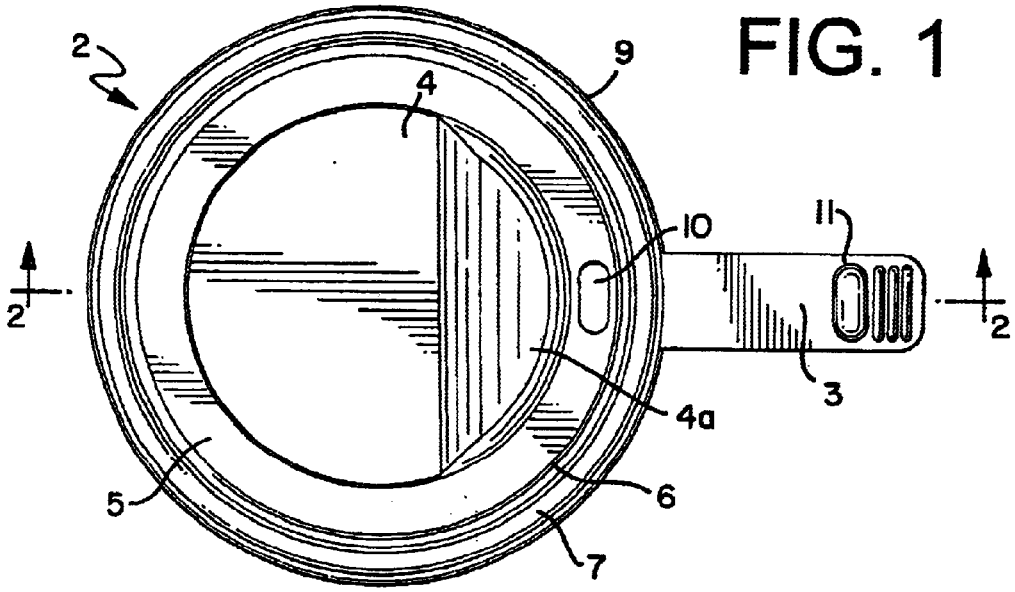
FIG. 1
FIG. 2
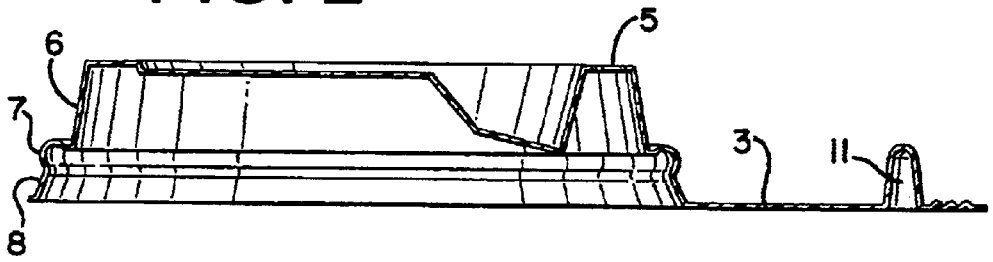
FIG. 3
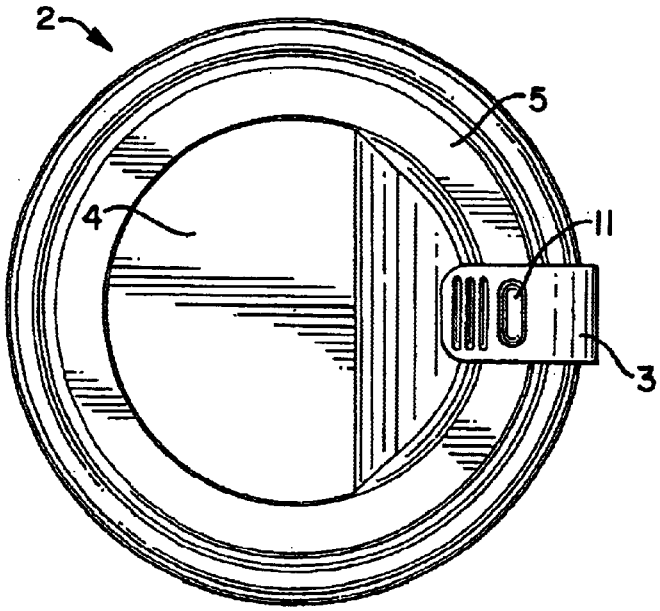

FIG. 4
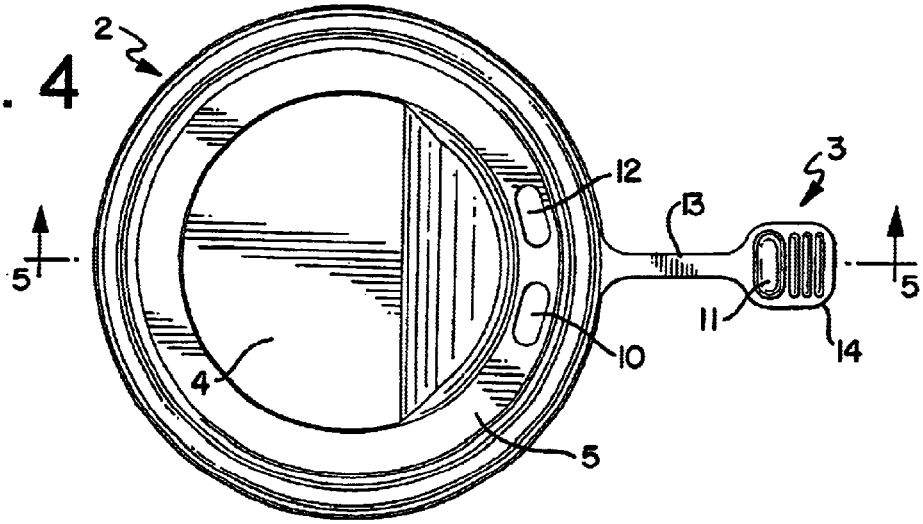
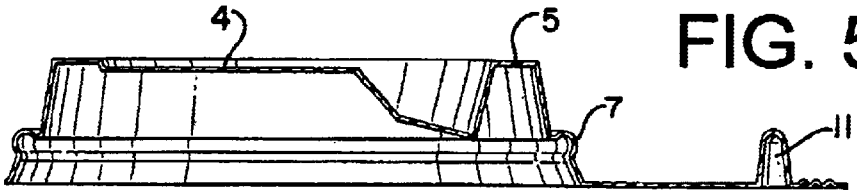
FIG. 5
FIG. 6
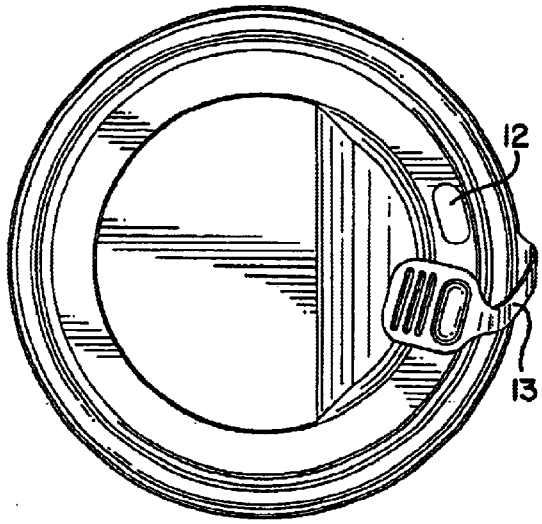
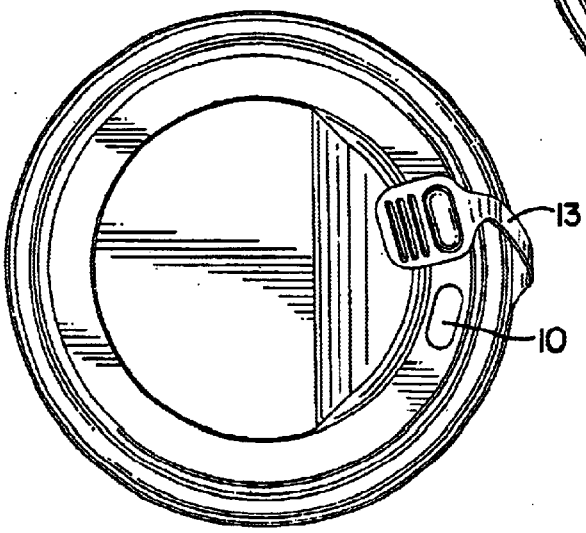
FIG. 7

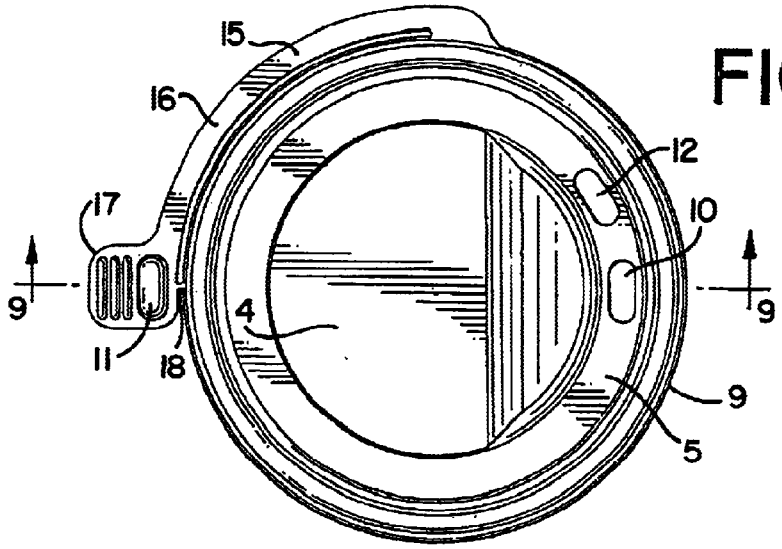
FIG. 8
FIG. 9
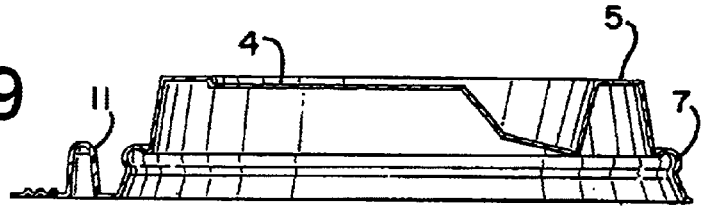
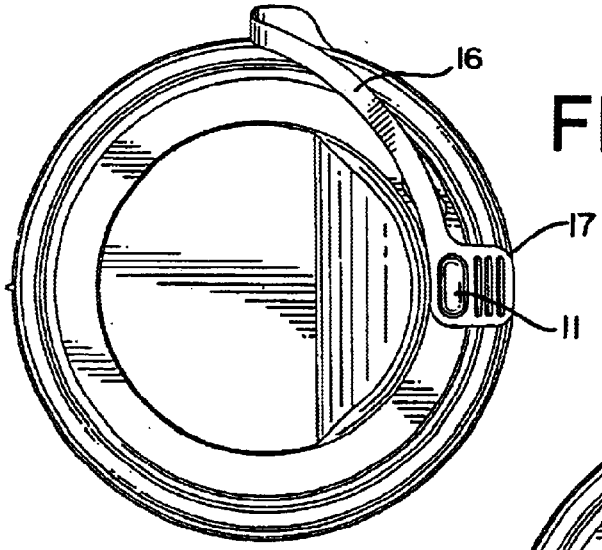
FIG. 10
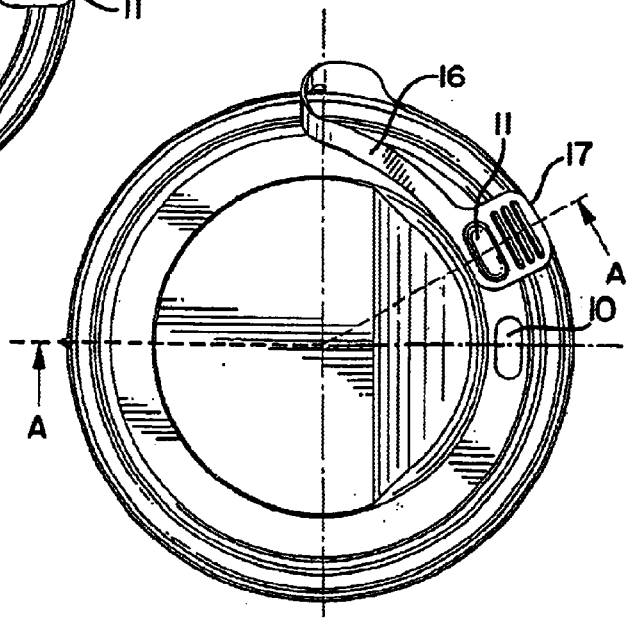
FIG. 11

LID

This application claims priority from U.K. Patent Application No. 0112077.3 filed May 17, 2001.

THIS INVENTION RELATES TO lids for containers, such as "take-away" hot and cold beverage containers.

Conventionally, a number of different types of lids may be used for hot and cold beverage containers, which are usually in the form of plastics or paper cups. Such lids are intended to provide a degree of retention of the beverage in the container when that container is accidentally knocked, shaken or tilted, whilst also allowing the beverage to be consumed as required. Such containers and such lids are single-use disposable items and, accordingly, must be capable of being produced at a low cost.

A typical disposable lid for such a beverage container is formed from thin plastics sheet material, for example by vacuum forming, and comprises a top panel with a downwardly depending peripheral rim. The plastics material of the lid is somewhat resilient so that the lid can be fitted over the open top of a suitably sized beverage container so that the rim of the lid grips the rim of the open end of the container, whereby the beverage is retained within the container. When the user wishes to drink the beverage, he or she must first remove the plastic lid and subsequently drink from the container as from a conventional cup. If the user subsequently wishes to store some of the beverage until later then he or she can replace the lid accordingly. The disadvantage of such a lid is that when the lid is removed, so that the user may drink from the container, the whole of the open end of the container is exposed resulting in a high risk of spillage of the beverage should the container be accidentally shaken, knocked or tilted.

In a known development of the basic plastic lid described above, a lid is provided with an aperture positioned at a point near to the rim of the lid. The aperture is chosen so that it is sufficiently enlarged to allow a user to drink from the container without having to remove the lid itself, but sufficiently small to reduce the risk of spillage of the beverage if the container is tilted or shaken. In addition, the aperture may be initially blocked by a press out tab or flap which can be pushed into the container when initial discharge of the beverage is required. However, although such an arrangement reduces the risk of spillage compared to the basic removable plastic lid, spillage may still occur upon undesired tilting or shaking of the container. Furthermore, once the tab or flap which covers the aperture has been pushed in there is no further means provided on the lid for re-sealing the aperture should the user wish to save some of the beverage for consumption at a later date.

In yet another known modification of the basic plastic removable lid, two intersecting perpendicular slits are positioned at or around the centre of the lid so as to form four small flaps. The slits are sufficiently long, and the material of the lid is sufficiently thin and flexible, to allow a straw to be inserted at the intersection of the slots to deflect these flaps and pass the latter to extend into the beverage within the container, the beverage then being sucked from the container through the straw. Although the slit and straw arrangement largely prevents spillage of the beverage due to tilting or shaking, it does not completely prevent escape of the container contents, for example if the container is accidentally squeezed. Furthermore, the use of a straw to remove the beverage from the container is not always desirable, particularly in the case of hot beverages such as tea or coffee It is therefore an object of the present invention to provide a lid which can be fitted to a container to prevent spillage of the contents while allowing the contents to be easily consumed when required, and which is yet inexpensive to manufacture and store.

According to the present invention there is provided a container lid comprising:

i) a main body portion having an aperture therein; and ii) a flexible arm portion, attached to said body portion and having a closure member positioned thereon;

and in which the closure member, whilst still attached via the flexible arm portion to the main body portion, can be moved between a first position, in which the closure member closes off the aperture, and a second position, in which the aperture is open.

Preferably, said body portion further incorporates a retaining element capable of receiving said closure member, wherein the closure member, in a said second position, whilst still attached via the flexible arm portion to the main body portion, can engage with the retaining element, to be retained thereby.

Preferably, the lid, which may, for example, be formed by a vacuum forming or similar process conducted on an initially flat, thin sheet of plastics material deformable or mouldable when sufficiently heated, comprises a peripheral edge lying substantially in a plane and wherein said flexible arm portion is in the form of a web, or strip, a of a thickness small in relation to its initial width and length and which in an initial position thereof, in which the closure member is out of engagement with said aperture, lies in said plane of said peripheral edge, in one position of said arm portion.

Thus in manufacture of the preferred form of lid in accordance with the invention, by a vacuum forming or similar process, known per se, a large number of such lids are formed simultaneuously from an initially flat thin sheet of thermoplastics material heated to a temperature at which it is plastically deformable, and which process displaces, out of the plane of the sheet, portions defining a top and a surrounding rim of each lid. In such process, said closure for each lid is formed by similarly displacing the material of the sheet from said plane at a place in the sheet adjoining the displaced regions which will form the top and rim of the respective lid, and thereafter such sheet material is severed around the periphery of said rim of each lid to define said edge in the plane of such sheet material and likewise there is severed, from the sheet material, a portion, remaining attached to the body portion of the respective lid, at such rim, to form said flexible arm terminating in said closure. The aperture in the lid may be formed at this stage by punching out a patch of the sheet material, in the top of the lid, of a size and shape corresponding to the cross-sectional shape of the projection or protrusion, which forms said closure, or an area apt to form such aperture may simply be defined at this stage by forming a line of weakness in the respective lid top around the intended periphery of said aperture, to allow the aperture to be formed at a later stage, for example by the end user of the lid, by punching out the region bounded by that line of weakness.

Embodiments of the invention are described below by way of example with reference to the accompanying drawings, in which FIG. 1 is a plan view of a first embodiment of the present invention with the aperture open.

FIG. 2 is a cross-sectional view of the lid of FIG. 1 along the line 1—1 in FIG. 1.

FIG. 3 is a plan view of the lid of FIG. 1 with the aperture closed off.

FIG. 4 is a plan view of a second embodiment of a lid according to the present invention showing the aperture in an open position.

FIG. 5 is a cross-sectional view of the lid of FIG. 4 along line 2—2 in FIG. 4.

FIG. 6 is plan view of the lid of FIG. 4 showing the aperture closed off.

FIG. 7 is a plan view of the lid of FIG. 4 showing the arm portion in a retained position.

FIG. 8 is a plan view of a third embodiment of a lid according to the present invention showing the aperture in an open position.

FIG. 9 is a cross-sectional view of the lid of FIG. 8 along line 3—3.

FIG. 10 is a plan view of the lid of FIG. 8 showing the aperture closed off.

FIG. 11 is a plan view of the lid of FIG. 8 showing the arm portion in its retained position.

The lids shown in the drawings are made, as lids of this general sort commonly are, by subjecting a thin, initially flat, planar sheet of thermoplastics material to a forming process, such as a vacuum forming or pressing process, whilst it is at a temperature at which it is readily plastically deformable, the effect of the process being to displace some of the material of the sheet to predetermined degrees out of the original plane of the sheet material. After such deformation, the plastics material is severed around the moulded regions which define the products, to free the thus formed lids from the remainder of the sheet material. The plastics material used is of a springy resilient character at temperatures below its softening point or range.

FIGS. 1 and 2 show a lid 1 having a circular body portion 2 and a flexible arm portion 3. The body portion 2 includes a central region 4, surrounded by an elevated, generally planar circular annular region 5 incorporating an aperture 10. The circular annular region 5 is bounded, at its outer edge, by a circumferential wall 6, sloping downwards and outwardly from the edge of circular region 5 to a level below that of the plane of central region 4. The lower edge of wall 6 merges with a region of arcuate vertical cross-section, which defines a resilient rib 7 which projects outwardly from the bottom of the wall 6. Extending from the base of the rib 7, on the side opposite the wall 6, is a generally frustro-conical, resilient skirt 8, defining a peripheral edge 9 lying in a plane which corresponds to the plane of the undeformed sheet material from which the lid was formed as described above. A major part of the central region 4 surrounded by the elevated, generally planar circular annular region 5, is generally planar, but a segment, (in the geometrical sense), 4*a* of this central region is recessed below the plane of part 4, and significantly below the level of annular region 5 with the aperture 10 being disposed centrally with respect to the circular arc defined by this segment. This arrangement, known per se, facilitates drinking from the container to which in use the lid is fitted, by sipping through the aperture 10.

The arm portion 3, which is, in effect, a strip of the undeformed sheet material referred to, extends in a radial direction from a position on the rim 9 adjacent the aperture 10, and incorporates adjacent its end opposite the rim 9, a closure member 11, in the form of a hollow upwardly projecting, upwardly tapering dome (likewise formed by displacement of material from the original plane of the plastics sheet material during the vacuum forming process) of which the cross sectional size and shape at an intermediate height correspond with those of the aperture 10. The end of the arm 10 on the side of the closure remote from the main body of the lid, may, as shown, be formed with transverse ribs to facilitate manual gripping of said end.

It will be understood that the thickness of arm 3 is that of the undeformed sheet plastics material so that the arm is actually very thin in relation to its length and breadth as measured in the plane of said sheet material and that consequently, the arm is very flexible in directions transverse to such plane.

As is shown in FIG. 3, the position of the closure member 11 along arm portion 3 is such that, by bending the arm portion over the top of the body portion 2, the closure member can be engaged with the aperture so as to seal it. Secure substantially sealing engagement being made possible by the taper on the closure member and the resilience of the material of the enclosure and the lid.

In use, the lid can be fitted to a container, containing a beverage, having an open end which is of substantially the same radius as the rim 9 of the lid, or rather which is such that the lid is a light force fit over said open end. The resilience of the skirt 8 allows the rim 9 of the lid to be stretched over the open end of the container until the rim of the container engages with the interior of the formation defining the hollow rib 7 of the lid. The resilience of the hollow rib 7 serves to grip the rim of the container and provide a degree of retention of the beverage within the container. When the aperture is open, the user may drink the beverage through the aperture, without the need for a straw, the size of the aperture 10 being chosen so as to be sufficiently small to reduce the risk of spillage when the aperture is open. Should the user wish to consume the contents of the container at a later time, he or she may bend the flexible arm portion 3 over the top of the lid and push the closure member 11 into the aperture so as to plug the aperture and prevent the escape of any liquid as the container is carried around. When the user requires to consume some more of the beverage within the container, he or she can simply unplug the aperture by bending back the arm portion and removing the closure member accordingly. It will be appreciated that the lid need not be circular, or indeed of any set radius, and can be made so as to fit any desired shape of container, for example a container with an open end of square or rectangular cross-section. Similarly, the surface relief of the lid, particularly the central portion, need not be that shown in FIGS. 1–3, but may in fact be any desired configuration depending on the application or use of the container to which it is to be fitted.

FIGS. 4 and 5 show a second embodiment of a lid according to the present invention, which differs from that of FIGS. 1 to 3 only in that the aperture 10 is in a slightly different position on the annular region 5; that the annular region 5 further incorporates a recess 12 adjacent, and approximately equal in size to, the aperture 10, and that a major portion 13 of the arm 3 is substantially narrower than the arm 3 in the embodiment of FIGS. 1 to 3. The arm 3 extends outwardly from the rim along a radius of the body portion 2 which lies in the plane of symmetry of the depressed segment within the annular region 5, the aperture 10 and recess 12 being equally spaced from this plane of symmetry on opposite sides thereof. The narrow portion 13 of arm 3 extends from adjacent the rim of the lid to a wider head portion 14, which carries the closure member 11. As shown in FIG. 6, when it is required to close off the aperture 10, arm portion 12 can be bent over the top of body portion 2, the narrow portion 13 allowing the arm portion to be twisted so that closure member 11 may engage with aperture 10 so as to plug it. As is shown in FIG. 7, when it is required to have the aperture open, so that the contents of a container to which the lid is fitted may be extracted, the closure member 11 can be moved from the aperture 10 and lodged securely in the recess 12, preventing any unwanted movement of the arm portion 13 which would interfere with sipping the contents of the container through the aperture 10. The recess 12 which is of course also formed during the vacuum forming operation, is a blind recess (providing no further clear hole through the lid), may have an internal shape and size conforming substantially to the external shape and size of the closure member, so that the closure member can be wedged snugly into the recess 13.

FIGS. 8–11 show a yet further embodiment of a lid according to the present invention, which differs from that of FIGS. 4 to 7 only in the location and form of the flexible arm (referenced 15) and in the locations of the aperture 10 and recess 12. Thus, in FIGS. 8 to 11, the flexible arm takes the form of an arcuate strip which closely follows the rim/edge 9 of the main body of the lid through an arc of approximately 90 degrees. As in the previous embodiments, the arm is really part of the undeformed sheet material from which the lid was formed and initially lies in the same plane as that undeformed sheet material. In this instance, the arm is in effect a flange-like continuation, in the last noted plane, of the rim edge of the lid but is separated from the lid over most of the length of the arm by an arcuate incision between the inner edge of that arm and the edge proper of the main body of the lid. Indeed, in a variant, the arm may remain attached to the rim throughout the whole length of the arm until the lid is to be used or is in use, with the arcuate incision referred to being replaced by a line of weakening (eg. an arcuate row of perforations) so that the end user can pull the main part of the arm 15 from the lid rim when the closure element is to be used.

In FIGS. 8 to 11, the flexible arm 15 comprises a narrow arcuate portion 16 and a head portion 17 carrying closure member 11 and provided with gripping ribs. The end of arm 15 remote from the head portion 17 is continuous with the rim of the lid, the major part of the arm is separated from the lid by the arcuate incision referred to and head portion 17 is attached to a first position on the rim 9, radially opposite the aperture 10, by a narrow bridge 18 which holds the arm and the closure member in place until required. As shown in FIG. 8, the aperture 10 and the head portion with closure member 11 are diametrally opposite one another, i.e. spaced apart by 180 degrees around the circumference of the lid and the location at which the end of the flexible arm remote from the closure member is permanently secured to the lid is substantially 90 degrees between the two. In the arrangement shown, the retaining recess is located somewhat closer to the lid end of the arm than the aperture 10 is. The end of arcuate portion 16 opposite the head portion 17 is attached to a second position around the rim 9, the second position lying between the positions around the rim of the head portion 17 and aperture 10, and separated from both by approximately 90°. As can be seen in FIG. 10, when the aperture is required to be closed off, for example when it is intended to take a drink away for consumption at a later stage, the user may pull at point A and tear the tag so as to free the head portion 17. Once the narrow bridge 18 has been broken, the flexible arcuate portion 16 may be bent over the top of the body portion 2 so as to engage the closure member in the aperture 10 and plug the aperture accordingly. Upon removing the closure member subsequently from the aperture, for example to consume the contents of the beverage container, the closure member 11 can be engaged with recess 12 on body portion 2 so as to retain the arm portion in a substantially fixed position to allow the user to drink easily through the aperture 10.

The lids in accordance with the invention can be manufactured, eg. by a vacuum forming process, substantially as easily as, and as cheaply as, conventional beverage container lids. The material forming the closure and flexible arm may, in this case, be formed from portions of the sheet material which would otherwise form part of the "scrap" remaining after removal of the formed lids from the remainder of the sheet material, so that no significant additional material cost is involved in manufacture of lids in accordance with the invention.

It will be appreciated that the position and dimensions of the arm portion, recess and aperture, with respect to the body portion, are limited only by the fact that the user must be able to locate the closure member within the aperture or recess, whichever is desired, by bending the arm portion the required amount. Accordingly, the arm portion in the embodiment of FIGS. 8–11 could equally be placed so that the arcuate portion stretches around any arc length of the rim 9 as long as the length of the arcuate arm portion and position of attachment allowed the arm portion to be bent so that there was a good engagement between the closure member and the aperture. For example, referring to FIGS. 8–11, it may be particularly convenient if the arcuate section of the arm portion extended in a clockwise direction from the point of attachment such that the head portion and closing member were adjacent the aperture 10.

Similarly, while all of the specific embodiments above disclose a closure member in the form of a hollow projecting element, equally the aperture could be in the form of a projecting spout and the closure member could be a hollow cap which fitted over the spout so as to seal off the aperture. Indeed, any number of arrangements are envisaged whereby, upon bending the arm portion, a closure member can be used to shut off the aperture as required.

In the present specification "comprise" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A container lid comprising:

a body having an annular top wall, the annular top wall having both an aperture and a recess wherein the recess is adjacent the aperture;

an arm attached to a portion of said body and having a closure member positioned thereon;

and in which the closure member can be moved between a first position, in which the closure member closes off the aperture, and a second position, in which the aperture is open and the closure member is received by the recess.

2. The lid of claim 1, further comprising a peripheral edge lying substantially in a plane and wherein said arm portion has a thickness small in relation to its initial width and length and which in an initial position thereof, in which the closure member is out of engagement with said aperture, lies in said plane of said peripheral edge, in one position of said arm portion.

3. The lid of claim 1, wherein the lid is formed by acting upon a initially flat sheet of plastically deformable material, to displace, out of the plane of the sheet, portions defining a top and a surrounding rim of the lid, by severing such sheet material around the periphery of said rim to define an edge in the place of such sheet material and by severing, from the sheet material, a portion, remaining attached to such rim, to form said flexible arm and wherein said closure member is formed by displacing the sheet material at an end region of said arm, from said plane, in the form of a hollow projection or protrusion, said aperture being formed by punching out a patch of such material, in such top, of predetermined size and shape corresponding to the cross-sectional shape of such projection or protrusion, or an area apt to form such aperture being defined by forming a line of weakness in said top around the intended periphery of said aperture, to allow the aperture to be formed at a later stage, for example by the end user of the lid, by punching out the region bounded by said line of weakness.

4. A lid according to claim 1, wherein said body comprises a peripheral edge defining a plane, wherein in an initial position said arm extends in an arc partially around said peripheral edge and in the plane of said peripheral edge.

5. A lid according to claim 4 in which, in said initial position, said arm, is removably connected to the body along a line of weakness whereby the arm can readily be severed from the body.

6. A lid according to claim 4, wherein said closure member tapers externally away from the plane of said arm, allowing the closure member to be wedged snugly into said aperture for effective closure of the aperture.

7. A lid according to claim 1, wherein said recess receives said closure member in said second position to hold therein.

8. A lid according to claim 7, wherein said retaining recess comprises a blind cavity formed in said body and wherein the retaining recess has an internal shape and size corresponding to that of said closure member.

9. A lid according to claim 7 wherein, in said initial position, said arm extends generally radially from a periphery of the body.

10. The lid of claim 7, further comprising a peripheral edge lying substantially in a plane and wherein said arm portion has a thickness small in relation to its initial width and length and which in an initial position thereof, in which the closure member is out of engagement with said aperture, lies in said plane of said peripheral edge, in one position of said arm portion.

11. A container lid comprising:

a body having an annular top wall and a recessed central portion, the annular top wall having both an aperture and a recess wherein the recess is proximate the aperture;

an arm attached to a portion of the body and having a closure member positioned thereon, wherein the arm is movable between a first position where the closure member is received by the aperture and a second position where the closure member is received by the recess.

12. A container lid comprising:

a body having an annular top wall and a mounting skirt for connecting the lid to the container, the annular top wall having an aperture, the mounting skirt having a curvilinear configuration; and, an arm attached to the mounting skirt, the arm having a head portion with a closure member positioned thereon, the arm further having a curvilinear portion wherein the head portion and the curvilinear portion conform to the curvilinear configuration of the mounting skirt, and wherein the arm is movable between a first position where the closure member is received by the aperture and a second position where the aperture is open.

13. The container lid of claim 12 wherein the curvilinear portion of the arm has an arcuate configuration.

14. A container lid comprising:

a body having an annular top wall defining a first plane, the top wall having an aperture, the body further having a mounting skirt;

an arm attached to the body and defining a second plane that is displaced from the first plane, the arm having a closure member positioned thereon, the arm further having a curvilinear portion that along with the closure member conforms with a curvilinear portion of the body, and wherein the arm is movable between a first position where the closure member is received by the aperture and a second position where the aperture is open; and, wherein the body and arm are formed by (i) acting upon a initially flat sheet of plastically deformable material, to displace, out of the plane of the sheet, portions defining the top wall and the skirt, (ii) severing the sheet material around the periphery of the skirt, (iii) severing a portion of the sheet material to form the arm with the second plane that is displaced from the first plane of the top wall; (iv) displacing the sheet material at an end region of the arm to form the closure member in the form of a protrusion, and (v) punching out a region of the top wall to form the aperture with a configuration corresponding to the configuration of the closure member.

15. A container lid comprising:

a body having a generally horizontal top wall, the top wall having both an aperture and a recess in the top wall wherein the recess is adjacent the aperture;

an arm attached to a portion of said body and having a closure member positioned thereon;

and in which the closure member can be moved between a first position, in which the closure member closes off the aperture, and a second position, in which the aperture is open and the closure member is received by the recess.

* * * * *

UNITED STATES PATENT AND TRADEMARK OFFICE

CERTIFICATE OF CORRECTION

PATENT NO. : 6,644,490 B2
DATED : November 11, 2003
INVENTOR(S) : Brian Norman Clarke It is certified that error appears in the above-identified patent and that said Letters Patent is hereby corrected as shown below:

Title page,
Item [56], References Cited, FOREIGN PATENT DOCUMENTS, change "WO 00 151908" to -- WO 00 51908 --

Signed and Sealed this

Eighteenth Day of January, 2005

JON W. DUDAS
*Director of the United States Patent and Trademark Office*